US008123225B2

(12) United States Patent
McLaughlin

(10) Patent No.: US 8,123,225 B2
(45) Date of Patent: Feb. 28, 2012

(54) GAME APPARATUS AND METHOD OF PLAY FOR MANUAL OR COMPUTER APPLICATION

(76) Inventor: Patricia Marie McLaughlin, New York, NY (US)

( * ) Notice: Subject to any disclaimer, the term of this patent is extended or adjusted under 35 U.S.C. 154(b) by 11 days.

(21) Appl. No.: 12/928,518

(22) Filed: Dec. 14, 2010

(65) Prior Publication Data

US 2011/0111817 A1 May 12, 2011

Related U.S. Application Data

(63) Continuation-in-part of application No. 12/075,426, filed on Mar. 11, 2008, now abandoned.

(51) Int. Cl.
*A63F 3/00* (2006.01)

(52) U.S. Cl. ..... 273/236; 273/239; 273/271; 273/287

(58) Field of Classification Search ..... 273/236, 273/239, 271, 283, 284, 287
See application file for complete search history.

*Primary Examiner* — Vishu K. Mendiratta

(57) ABSTRACT

A game apparatus for play by at least two players, having game pieces that are manually rotated in at least four slideably mounted, apertured slats, each having at least four apertures with a rotating game piece, and a base assembly for slideably mounting the slats, such that the slats can be moved, and the game pieces rotated in the apertures, at the option of each of the players who take turns in playing the game. The game pieces are generally grouped in two different colors. The number of slats are generally the same as the number of apertures, and are preferably four or eight in number. The method of play by two players of apparatus involves each of the players taking turns that are selected from two possible moves: rotating a game piece in one of the apertures on one of the slats or linearly displacing one of the slats one stop. The game commences with all pieces on the board rotated to a neutral color, and with no home area for determining opening and winning of the game. A winner is determined when a player has a predetermined number of game pieces in a predetermined arrangement, generally four or eight in a row, or in a diamond or other configuration and where the configuration is not a home area. Also included is a virtual game board in which the game is controlled by a computer or group of computers as well as on the Internet.

16 Claims, 10 Drawing Sheets

GAME APPARATUS AND METHOD OF PLAY FOR MANUAL OR COMPUTER APPLICATION

CONTINUING DATA

This is a Continuance-in-Part application of U.S. Ser. No. 12/075,426, filed on Mar. 11, 2008 now abandoned.

FIELD OF THE INVENTION

The present invention relates to the field of games, and more particularly to a manipulatable game having attached, rotating triangular pieces, with apertured, slidable assemblies such that a turn comprises either rotating a piece to a player's color or movement of slidable assemblies in either a manual mode or automated by way of a computer application.

BACKGROUND OF THE INVENTION

An abstract strategy game is a strategy game aiming to minimize luck, and without a theme. Almost all abstract strategy games conform to the definition of: a board or card game, in which there is no hidden information, no non-deterministic elements (such as shuffled cards or dice rolls), in which (usually) two players or teams take a finite number of alternating turns.

Many classic board games, including Checkers, Chess, Go, and Mancala are strategy games. Play is sometimes said to resemble a series of puzzles the players pose to each other. There is an intimate relationship between abstract strategy games and puzzles where every board position presents the player with a puzzle that in theory could be solved by logic alone. A good abstract game can therefore be thought of as potentially interesting logic puzzles, and the play consists of each player posing such a puzzle to the other. Good players are the ones who find the most difficult puzzles to present to their opponents.

The following description and discussion of the prior art is undertaken in order to provide background information so that the present invention may be completely understood and appreciated in its proper context. This background provides reference to specific prior art relating to abstract strategy games.

U.S. Pat. No. 3,731,934 to Shoptaugh shows a board game consisting of fixed home positions on each side thereof with a plurality of sliders between the two home positions with spaces for the reception of the playing pieces of each of the players. The object of the game is to move one player's pieces from one home position to the other before the opponent can do so.

However, the object of the present invention is clearly distinguishable from the game shown in Shoptaugh. Furthermore, the subject invention is directed to a game apparatus and method of play, whereby a winner is determined when a player places a predetermined number of game pieces in a predetermined arrangement (such as a diamond, square, or other arrangement), which is critical to the instant invention. Shoptaugh, on the other hand, describes a game apparatus whereby a winner is determined by moving his playing pieces from one home area on one side of the board to the other home area on the other side before his opponent.

Accordingly, it is an object of the present invention to provide an unusual game apparatus, in which the game board surface can be changed or altered by a player as that player's turn, rather than simply placing another game piece on the surface.

Shoptaugh specifically teaches maze-like barriers that protrude upwardly from slats, such that by moving the slats mazes are formed that prevent or channel piece movement. The invention, as claimed, positively recites a flat, planar surface with wave forms for setting slats in exact position for the game board, lacking in any obstructive barriers and game pieces are not changed or moved from the apertures, only rotated within apertures to set the color of the player occupying that aperture, thereby distinguishing over this reference in every respect. Not only does Shoptaugh require reassemblable maze structures, Shoptaugh does not teach arranging game pieces in a predetermined pattern.

The addition of U.S. Pat. No. 3,588,113 to Nelson does little to change the traversal. Nelson shows a method of playing a game making predetermined patterns in the game by movable concentric circles each containing apertures for game pieces. The present claims require laterally slideably mounted slats structurally distinguishing over concentric circles. As such the combination of Shoptaugh and Nelson does not teach or suggest the current invention.

The game board is reconfigured laterally rather than circularly, allowing the game board to expand beyond the rectangular base. Slats can be moved off the base as long as one aperture is aligned with an aperture on an adjacent slat diagonally. The ability to extend slats in either direction allows for an undetermined and expanding playing field every time the game is played.

Lastly, U.S. Pat. No. 4,971,331 to Fabian, ostensibly to show computer implementation of games, does not fill the gaps presented in Shoptaugh alone, or in combination with Nelson. Hence the clear and apparent, positively claimed elements of the apparatus and method are patentably distinct over the art of record. The extending lateral slats reshape the playing field each play and the method of play allows a player only one option per turn, either occupy an aperture by rotating the piece to their color OR move a slat one position in either lateral direction.

Accordingly, it is an object of the present invention to provide an unusual game apparatus, in which the game board surface can be changed or altered by a player as that player's turn, rather than simply rotating another game piece on the surface, can slide a slat to change the configuration.

It is an additional object of the present invention to provide a gaming apparatus and method of play, that permits bidirectional, slidable reassembly of the gaming surface and provides three modes of play: a first mode wherein gaming pieces are rotated to the neutral color (unoccupied) on the board at game commencement, a second mode wherein game pieces are rotated to a player's determined color at the option of the players during play, and a third game over mode wherein one of at least two players' game pieces are configured on slidable slats in a predetermined arrangement, and wherein said gaming surface is structured such that it lacks home positions in any of said modes for placement of said pieces.

Finally, it is a yet further object of the present invention to provide a computer-assisted version of the game apparatus, wherein the elements are virtual and created by software, but the gaming rules and methods are the same as that shown in the physical version.

SUMMARY OF THE INVENTION

The invention, as claimed and in sum, comprises a game and apparatus for playing the same, wherein a plurality of planar slats with wave form configurations on the bottom that correspond to the base wave forms to allow a stop action to slide the slat to exactly one position comprise the game board.

A metal strip adhered to the bottom of each slat is attracted to the magnetic strip adhered to the grooves in the base, keeping the slats secured to the base. Each slat solely contains apertures for the rotation of game pieces and otherwise is flat and lacking in obstructive barriers. Each play comprises either rotating a tri-colored triangular piece in an aperture to the player's color, or moving one slat one position. Two players each take turns, one after the other, until a certain, predetermined, winning pattern is formed.

The apertures on the slats must connect to at least one aperture diagonally on an adjacent slat. It is possible to continue play off the base as slats are moved.

The various features of novelty which characterize the invention are pointed out with particularity in the claims annexed to and forming a part of the disclosure. For a better understanding of the invention, its operating advantages, and specific objects attained by its use, reference should be had to the drawings and descriptive matter in which there are illustrated and described preferred embodiments of the invention.

The foregoing objects and other objects of the invention are achieved through a game apparatus for play by at least two players, having game pieces that are manually turned in at least four slideably mounted, apertured slats, each having attached rotational game pieces in each aperture, and a base assembly for slideably mounting the slats, such that the slats can be moved, and said game pieces rotated in said apertures, at the option of each of the players who take turns in playing the game. The base lacks a home area for commencement and completion of the game. The object of the game is to arrive at a linear arrangement (i.e., a number in a row) or a predetermined configuration (e.g., a diamond).

With respect to the method of play, after each player selects a game color, and the first to start is chosen in any of a variety of known manners, each player is permitted to choose between rotating a game piece to their color in an aperture or moving one of the slats. Once a piece is rotated to a player's color it cannot be changed, it becomes an occupied space by that player's color.

At the game commencement, all gaming pieces are rotated to the neutral position (i.e. white) on said base. The method of play by two players involves each of the players taking turns that are selected from two possible moves: rotating a neutral (unoccupied) game position in one of the apertures on one of the slats or linearly displacing any one of the slats one stop. It should be appreciated that in this manner, the game board itself is reconfigured by a player. Thus, for example, if one player has three in a row, by moving a slat, the three in a row position could disappear, as shown in greater detail in connection with the detailed description set forth below and the drawings appended hereto.

The complexity of play is different from a traditional board game, since a player may use his or her turn to reconfigure the board, thereby changing the dynamics of the piece arrangements. Likewise, by changing the board either a position is enhanced or a new position is established, since the configuration of the board itself is thereby altered.

A winner is determined when a player has a predetermined number of game pieces in a predetermined arrangement, generally four or eight in a row (horizontally, vertically or diagonally), or in a diamond or other configuration, Under the preferred embodiment, the number of slats are generally the same as the number of apertures, and are preferably four or eight in number. Likewise, winning is established generally by having four or eight in a row. Again, it should be appreciated that when a player has three or seven in a row, this does not automatically mean that that player wins the next turn. This is because the other player may block by rotating a neutral, or still open position, occupying that position on that row, or by moving one of the slats. It should further be appreciated that moving one of the slats may enhance that player's own position (in, for example, aligning a row), or, for that matter, may align the row in a way that allows the other player to win then, or on the next subsequent turn.

Also included is a virtual game board in which the game is controlled by a computer or group of computers. The manner of play is the same, but the game is controlled by software, and the user enters his or her move by mouse or keyboard action.

The foregoing and other features of the present invention will become apparent from the following detailed description considered in conjunction with the accompanying drawings. It is to be understood, however, that the drawings are designed solely for purposes of illustration and not as a definition of the limits of the invention.

DETAILED DESCRIPTION OF THE PREFERRED EMBODIMENTS

Figure 1:
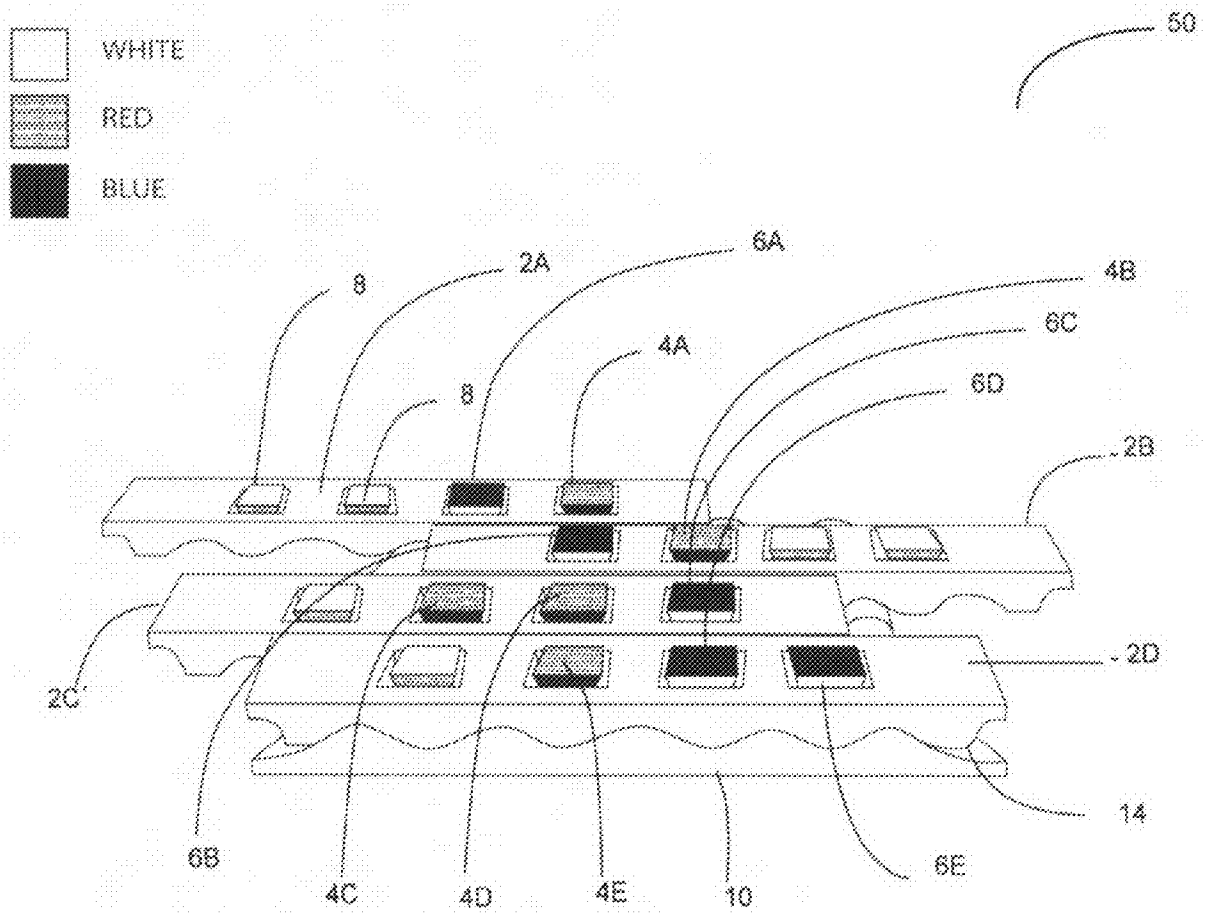
FIG. 1 is a perspective view of the game apparatus, in accordance with a preferred embodiment of the invention, showing four slatted assemblies with four apertures each, and rotating, triangular pieces attached to each aperture by a rod assembled such that the dark color wins.

In accordance with the subject invention, and with particular reference to FIG. 1, game device 50 is shown, in which the game board has been reconfigured to show a completion of play situation. In particular, game device 50 is comprised of a plurality of slideably-mounted, apertured slats, in this embodiment, four in number, shown as items 2A, 2B, 2C and 2D, placed in base 10. Slat 2D is shown in an original, game starting position, indicating that, during play, it has not been moved.

Each of slats 2A through 2D have corrugated bottom portions 14 that are, in this embodiment, wavably pronounced to enable a "stop" that provides the slat's mobility bidirectionally, in either direction as shown by the arrow indicated in FIG. 1. (As shown in further detail below, base 10 has corresponding waved pronouncements to permit relocation of the slats with a physical indicator (i.e., the relocation realigns) of a move.)

Accordingly, during play, slats (2A through 2D) are enabled to move a "stop" representing a location in either of the two directions indicated by the arrow. In particular, with reference to slat 2C, it should be appreciated that this slat was moved, during play, one "stop" leftwardly, as indicated by its dislocation one "unit" or stop to the left of slat 2D. Likewise, slat 2B was moved during play two stops rightwardly, and slat 2A two stops leftwardly.

In this embodiment as shown in FIG. 1, game pieces 6A through 6E are "dark" in coloration, representing one player's pieces, and in the particular apertures 8, rotating the piece to their color, turn by turn, by that player during play. Likewise, the "light" game pieces 4A through 4E were rotated by the other player in the particular apertures 8 during play. The slats 2A, 2B and 2C were moved during play. The result of game piece location and slat movement is the linear arrangement of four game pieces 6A, 6B, 6C and 6E in a diagonal row, thereby indicating that the "dark" piece player has won the game.

Figure 2:
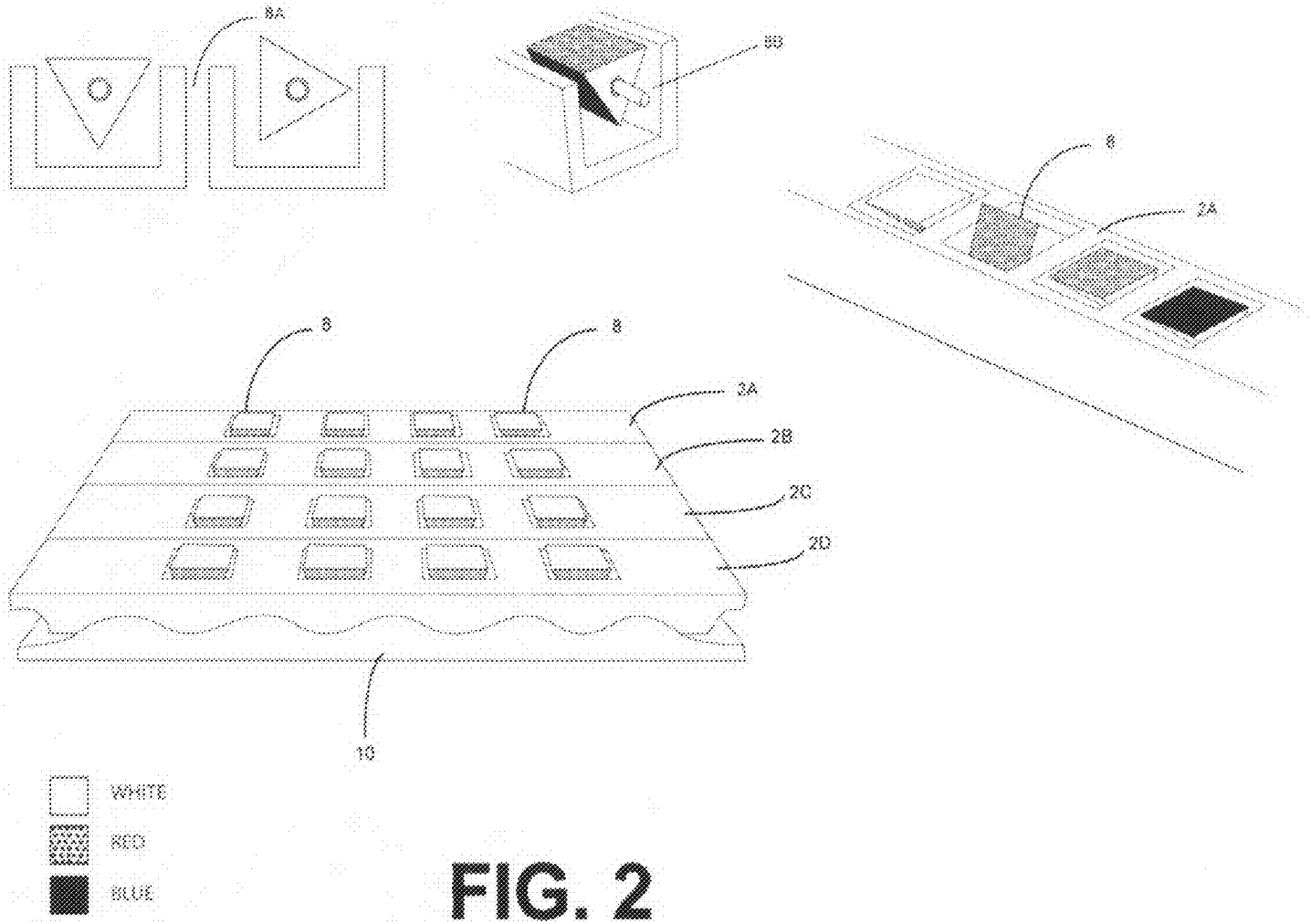
FIG. 2 is a perspective view of the game apparatus, in accordance with a preferred embodiment of the invention, showing the game board surface at commencement of play with all rotating pieces in each aperture turned to white showing on the surface, white being neutral or unoccupied by any player. Detailed drawings are included of the cross section of rotating triangular pieces with a different color on each face.

FIG. 2 shows the game board in the initial stage, prior to commencement of play. There are no game positions occupied, because play has not commenced, and slats 2A through 2D are in the "opening" position, in that the board, in this case a "four by four" in terms of number of apertures 8 and stops on the slats 2A through 2D, are all aligned in a square, on base 10. It should be appreciated that while this demonstrates a preferred "opening" or game-commencing position, other configurations of the apparatus can be presented as an opening without deviating from the spirit or scope of the claimed invention, as one of ordinary skill in the art can appreciate. Detail drawings show a straight on cross-section of the rotating, triangular pieces in the well of the aperture (8A), an angled view of one piece and the rod that attaches it to the slat (8B), and one slat with pieces being turned to one of the two players' colors.

Figure 3:
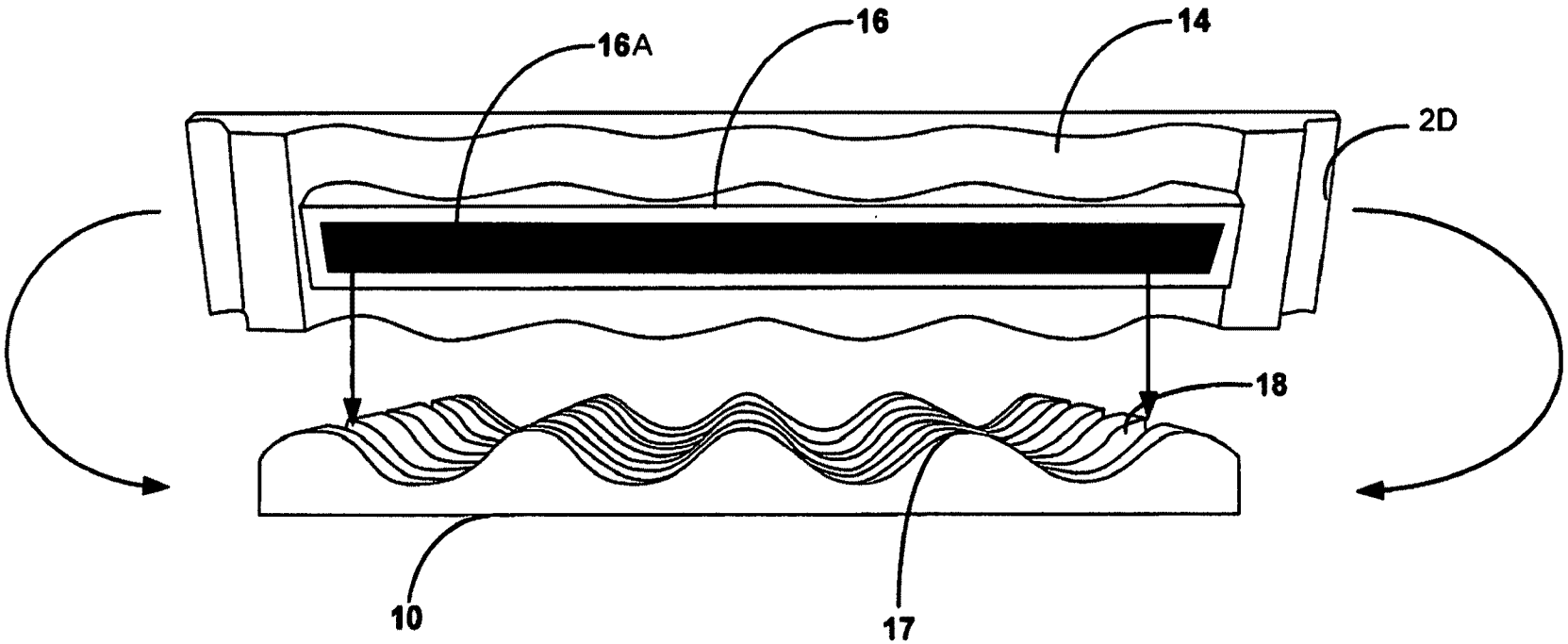
FIG. 3 is a breakaway view of one of the slatted assemblies with a metal strip that attracts the slat to the magnet on the base grooves and their directional orientation and location in the base assembly, in accordance with a preferred embodiment of the subject invention.

FIG. 3 reveals a perspective view of slat 2D, having waved pronouncements 14 on the bottom surface, and slides 16 that fit into corresponding slidable regions 18 on base 10. It should be appreciated that while only slat 2D is shown in FIG. 2, the other slats 2A through 2C also have the same configuration, and fit into corresponding slidable regions 18 on base 10. As a result of the waved pronouncements 14 and corresponding waved pronouncements 17 on base 10, each time a slat (2A through 2D) is moved in either of the bidirections shown by the arrow, the waved pronouncements rise the slat above the game board until resting in the next location. In this manner, a "stop" is provided, since realignment of the game board results after each of the bidirectional moves has been completed.

Figure 4:
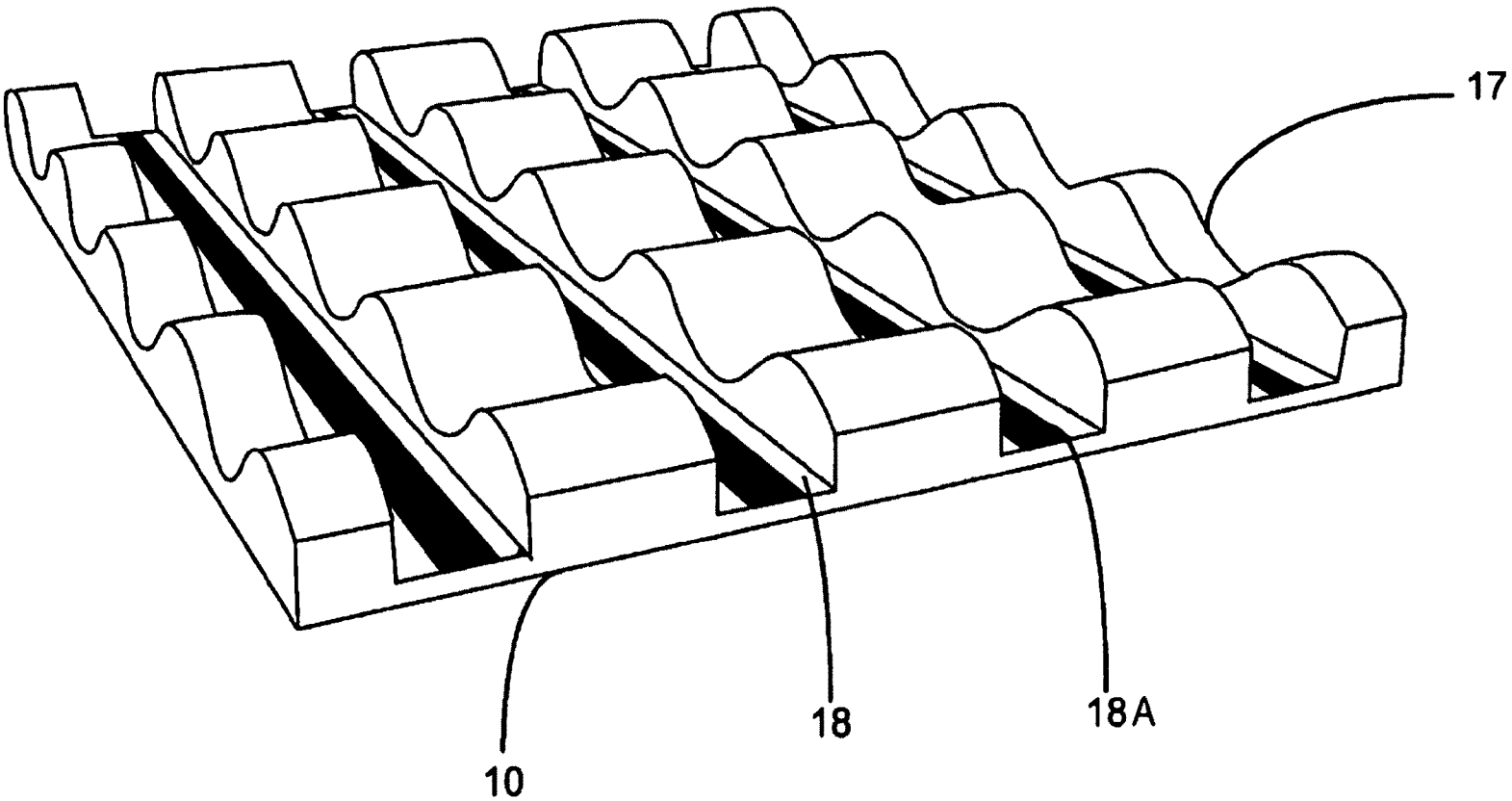
FIG. 4 is a perspective view of the base assembly with magnetic strips in the grooves in accordance with a preferred embodiment of the subject invention.

FIG. 4 shows, in greater perspective, base 10, comprising slidable regions 18 for receiving slides 16, magnetic strips 18A adhered to 18 to keep slats attached to base, and waved pronouncements 17 for carrying the slatted waved pronouncements 14.

Figure 5:
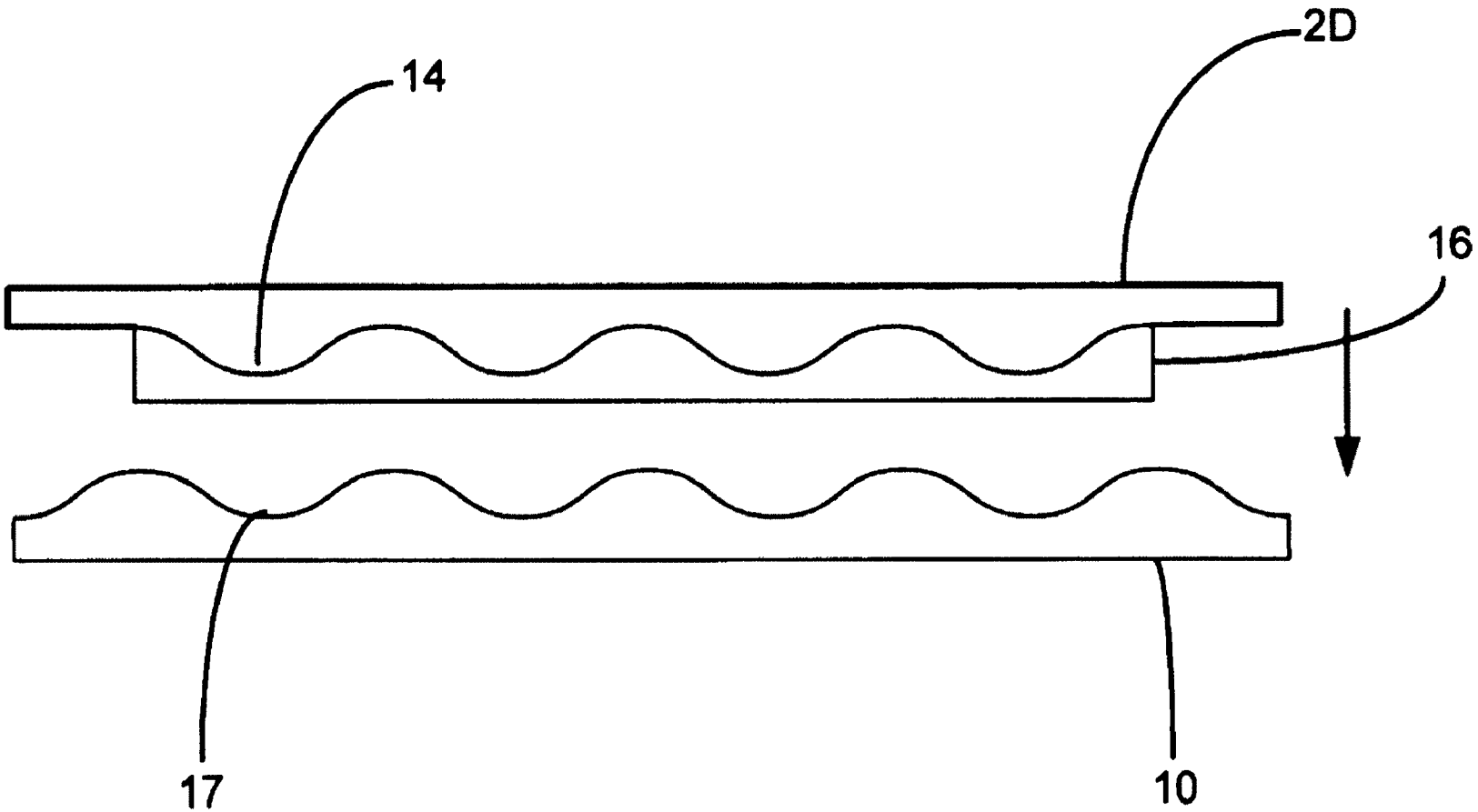
FIG. 5 is a side, frontal view of a slatted assembly and its directional location in the base assembly, in accordance with a preferred embodiment of the subject invention.

Likewise, FIG. 5 shows the perspective separation of slat 2D from base 10, in which slide 16 is shown, and the relationship between waved pronouncements 14 and 17 is made visibly evident.

Figure 6:
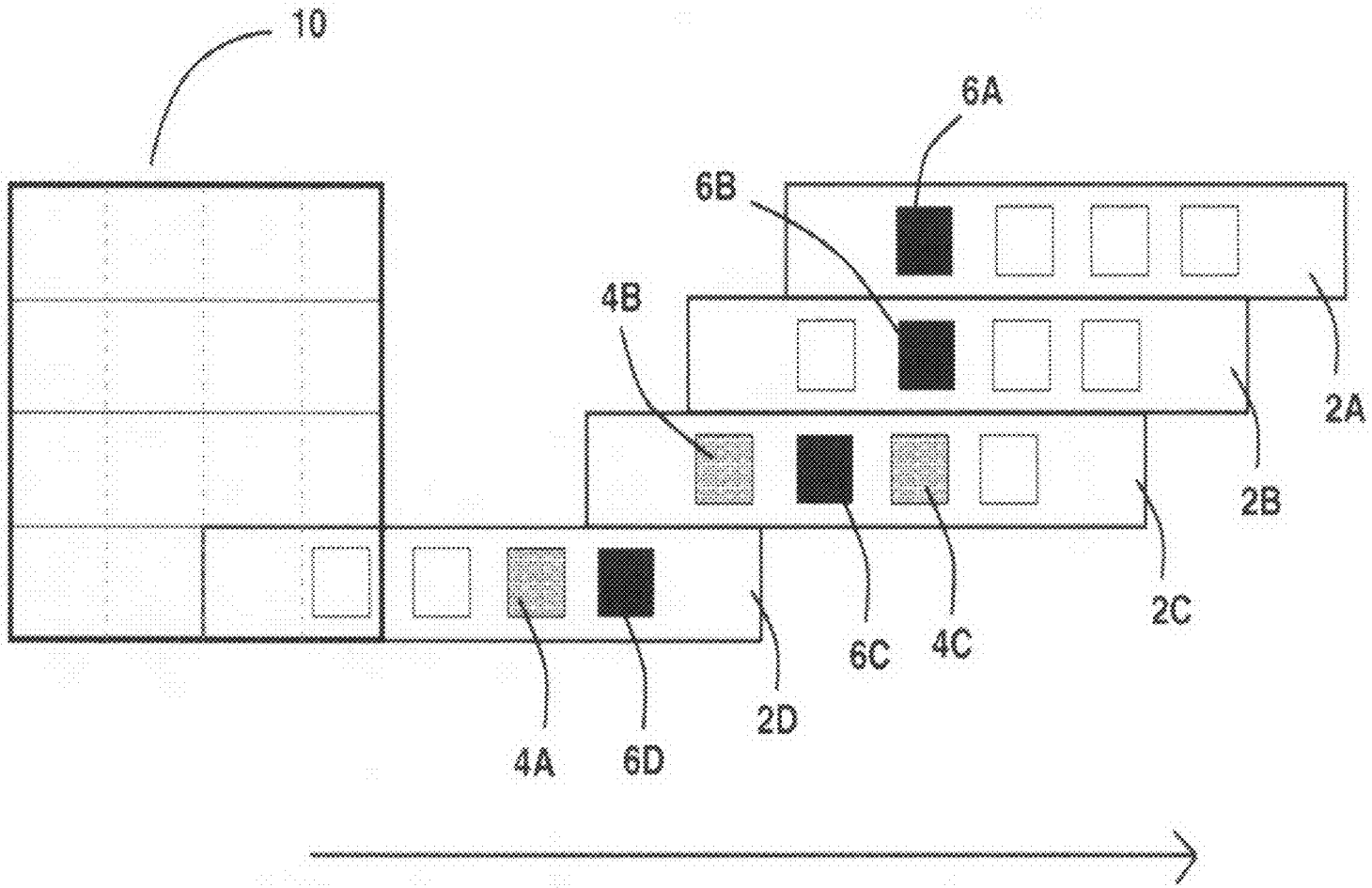
FIG. 6 is an overhead view showing the extended play from the base of the gameboard. It is possible to continue play off the base as slats are moved.

FIG. 6 shows the possible extended play from the base 10 of the gameboard. The apertures 8 on the slats (2A through 2D) must connect to at least one aperture 8 diagonally on an adjacent slat. The apertures need not be occupied. The bottom slat 2D has been moved to the right 3 stops, allowing slat 2C above it to move to the right 7 stops and still remain connected to slat 2D by the diagonal connection between apertures 6D and 4C, and so on, extending play off of the base. It is possible to continue play off the base as slats are moved and all apertures are adjacent to at least one other aperture, either horizontally, vertically or diagonally.

Figure 7:
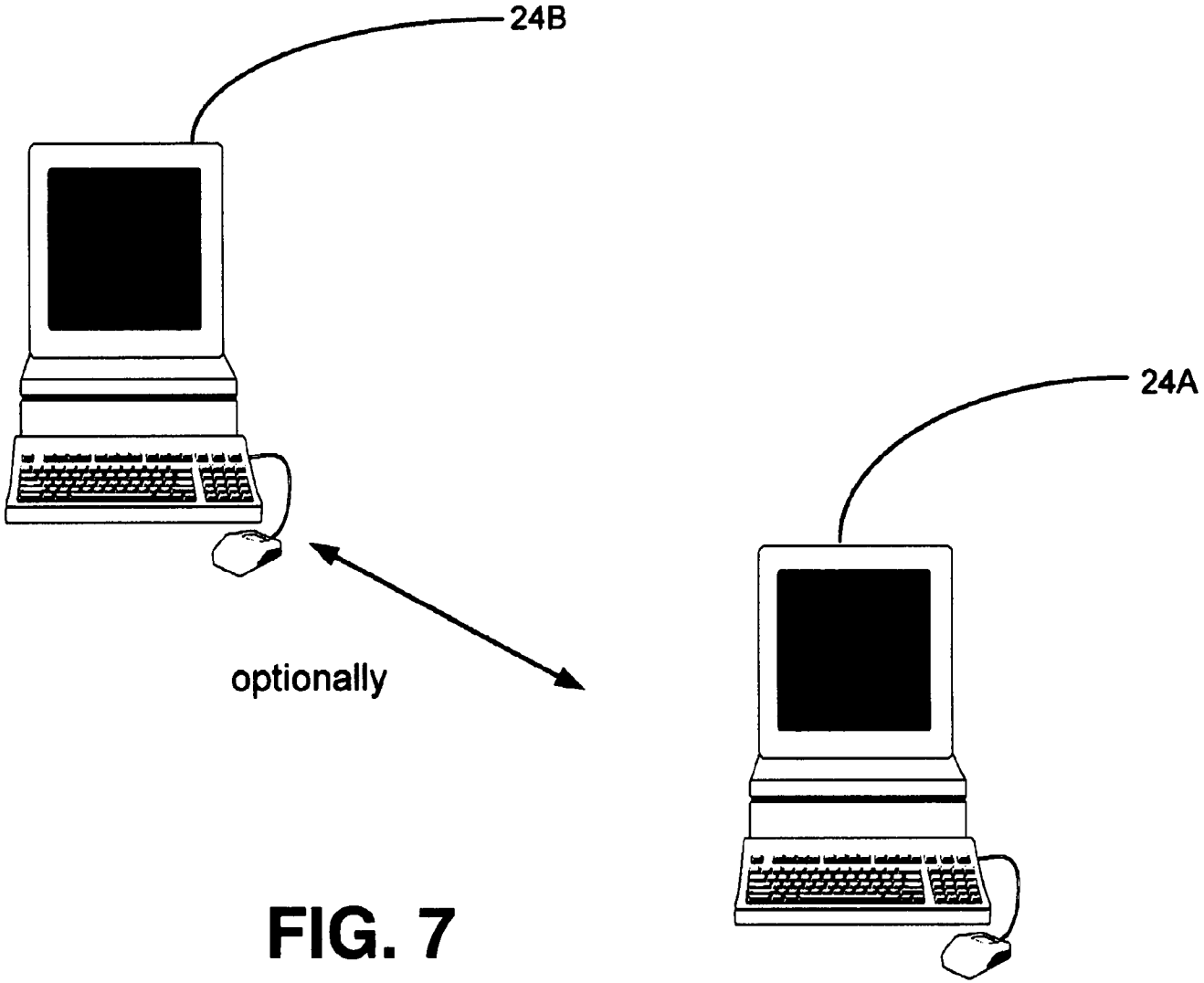
FIG. 7 is a perspective view showing a computer-aided version of the game apparatus, where the apparatus is virtual, and the game is played by two users on a single computer, or multiple users over the Internet or via an intranet.

Lastly, it should be appreciated that the game may be played in a virtual manner, in which the game is software created, and played by hardware control on a personal computer 24A, or by two personal computers 24A and 24B connection optionally by way of the Internet or an intranet, as shown by FIG. 7. The method of play is always the same.

Figure 8:
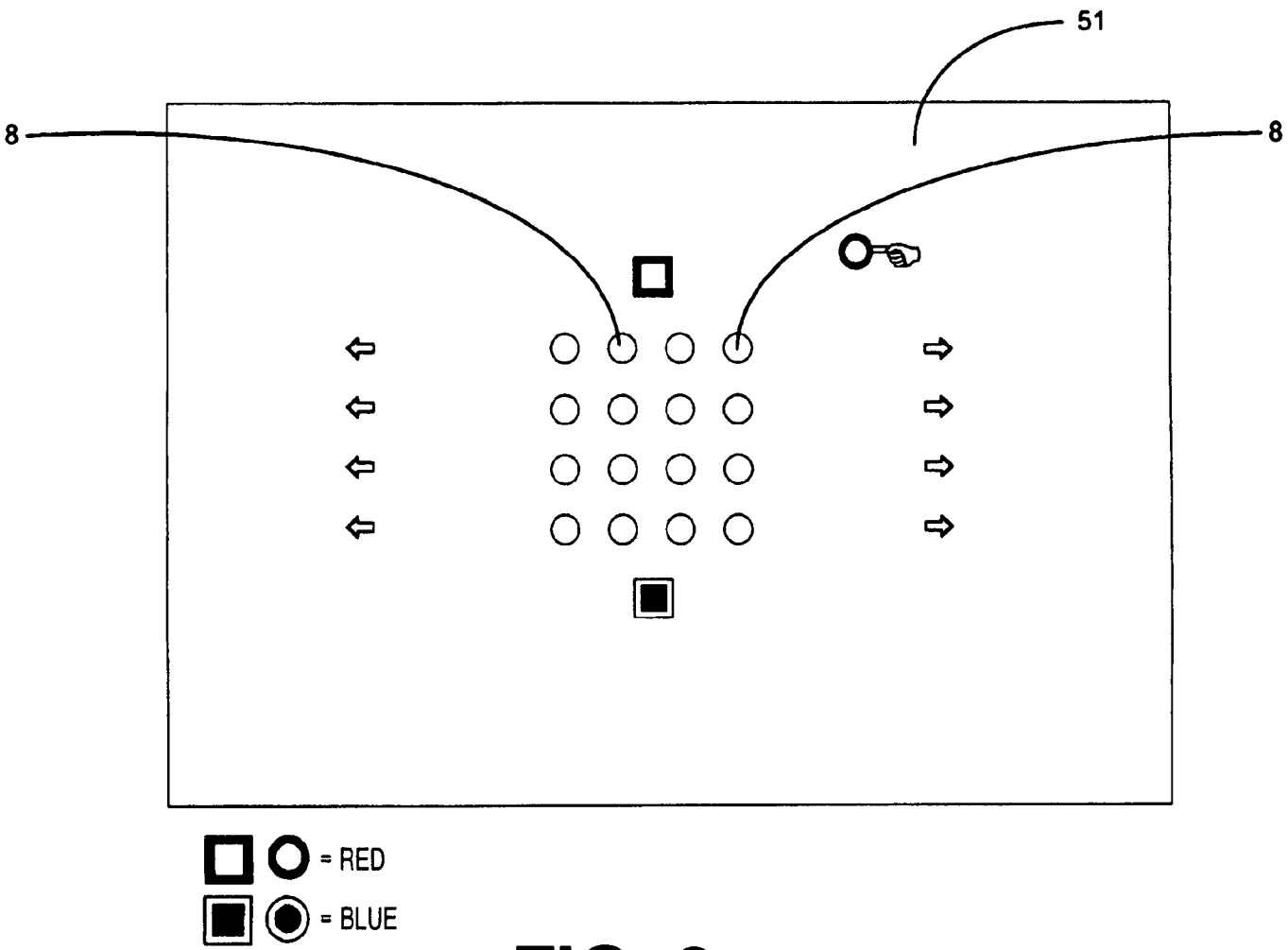
FIG. 8 is a screen shot of the virtual game board, in accordance with a preferred embodiment of the invention, showing the game board surface at commencement of play.

FIG. 8 shows the virtual game board 51 in the first, initial play mode, prior to commencement of play. There are no game positions occupied, because play has not commenced, and all of the apertures 8 are open, slats 2A through 2D are in the "opening" position, in that the board, in this case a "four by four" in terms of number of apertures 8 and stops on the slats 2A through 2D, are all aligned in a square, on base 10. It should be appreciated that while this demonstrates a preferred "opening" or game-commencing position, other configurations of the apparatus can be presented as an opening without deviating from the spirit or scope of the claimed invention, as one of ordinary skill in the art can appreciate.

Figure 9:
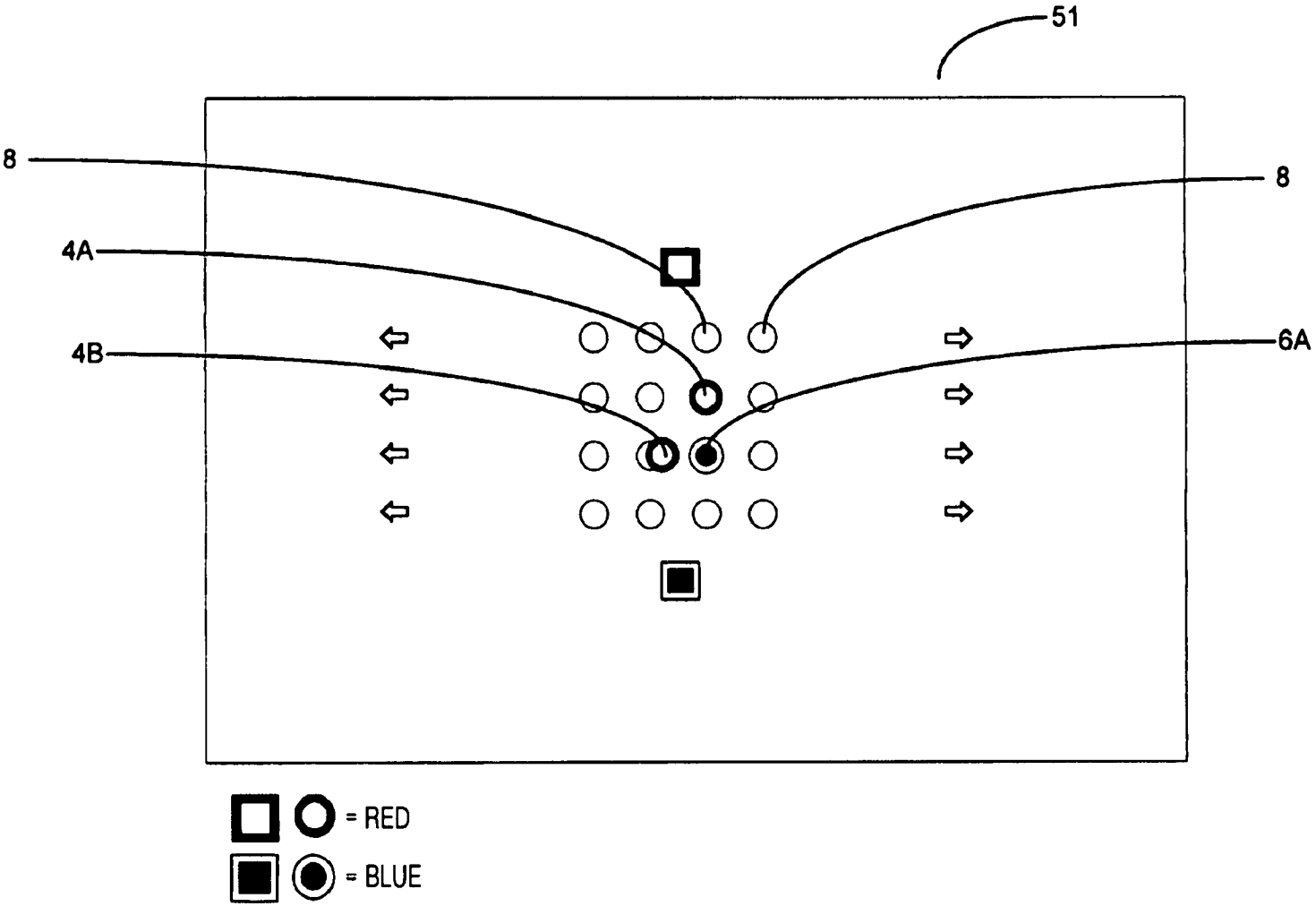
FIG. 9 is a screen shot of the virtual game board, in accordance with a preferred embodiment of the invention, showing the game board after play has been commenced.

FIG. 9 shows the virtual game board 51 in the second play mode, after commencement of play. The game pieces 4A and 4B are "light" in coloration, representing one player's pieces, and in the particular apertures 8, placed there, turn by turn, by that player during play. Likewise, the "dark" game piece 6A was placed by the other player in the particular apertures 8 during play.

Figure 10:
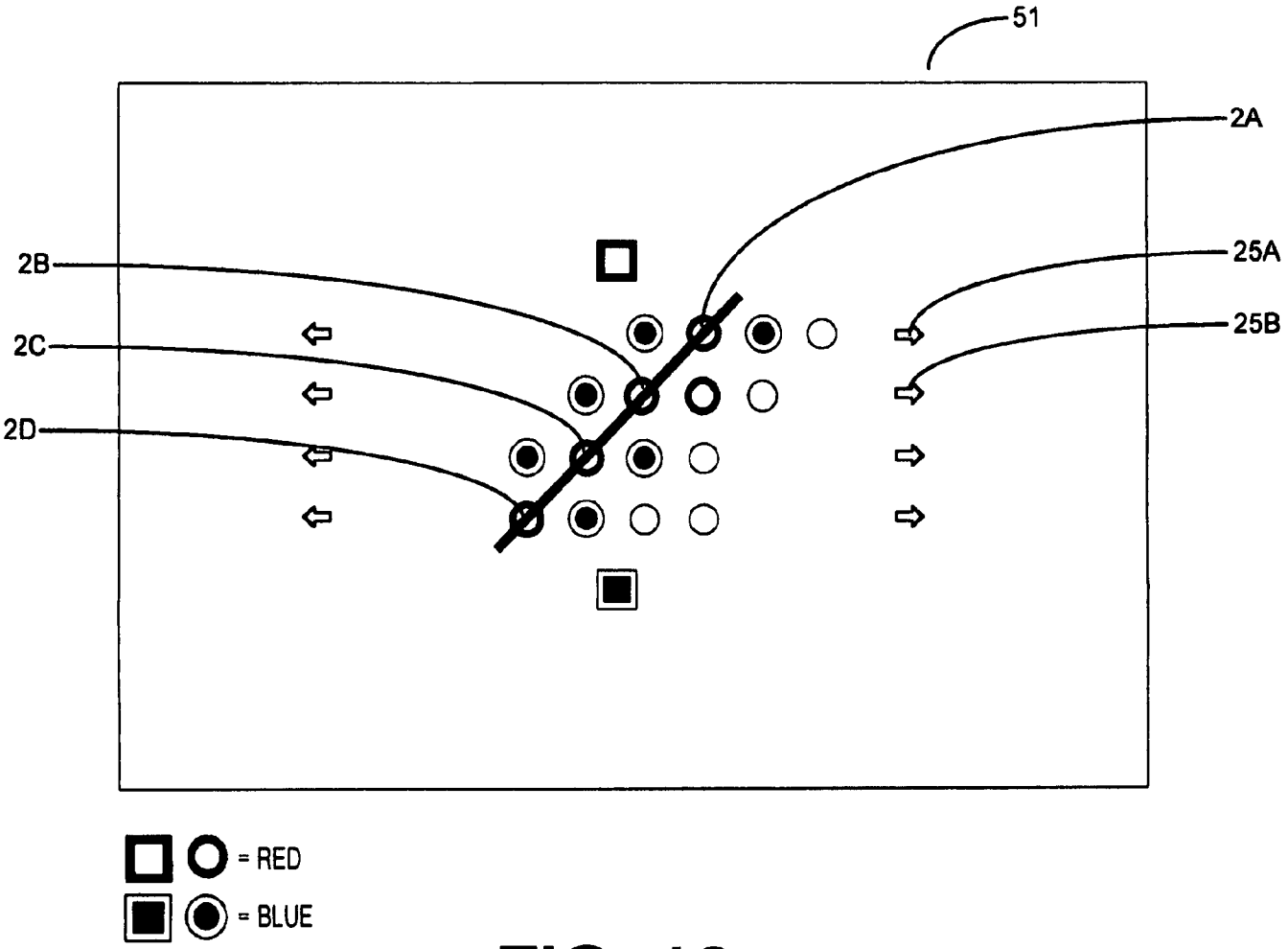
FIG. 10 is a screen shot of the virtual game board, in accordance with a preferred embodiment, showing four slats, with four apertures on each slat, and game pieces assembled such that the light color wins.

FIG. 10 shows the virtual game board 51 in the third, game over mode of play. The result of game piece location and slat movement is the linear arrangement of four "light" game pieces 2A, 2B, 2C and 2D in a diagonal row, thereby indicating that the "light" piece player has won the game.

With respect to the method of play, after each player selects a game color, and the first to start is chosen in any of a variety of known manners, each player is permitted to choose between rotating a game piece in an aperture or moving one of the slats. Game continues until a predetermined configuration is achieved. The predetermined configuration may be a line of a number of game pieces that depends from the size of the board, or a geometric shape, like a diamond.

The game board may have any of a number of slats and apertures, without deviating from the spirit or scope of the invention. Generally, the number retains a square arrangement, and is ideally 4 by 4 or 8 by 8, although other configurations are permitted in accordance with the invention.

While there have been shown, described and pointed out fundamental novel features of the invention as applied to preferred embodiments thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

I claim:

1. A game apparatus for play by at least two players, comprising:

a gaming surface comprising at least four laterally, horizontally and slideably mounted, adjacently-configured slats, each slat having a plurality of apertures; each aperture containing a rotating triangular piece with three faces, each face having a color distinct from other faces, the distinct colors representing a neutral state position, a first player position and a second player position; said gaming surface configured to provide three modes of play, a first mode wherein all triangular pieces are showing a neutral state color on the surface at game commencement, a second mode wherein game pieces are turned to the color of a player at the option of the player during play or alternately a slat is moved horizontally one position in either direction, and a third mode being a game over mode wherein all game pieces are turned to the color of a player in a predetermined arrangement on the surface as shown by apertured slats; each of said apertured slats having a top surface and a bottom surface, said top surface of a flat, planar configuration lacking in any obstructive barriers;

each slat further including magnet attractant metal strips and a wave configuration on the bottom;

a base assembly top surface for slideably mounting said slats, including a magnet strip and a corresponding wave configuration to attract the slat to the base after sliding the slat one position demarcated by the waves alignment, thereby moving the slats and rotating the game pieces occupying said apertures, at the option of each player.

2. The game apparatus of claim 1, wherein each aperture contains a rotating triangular piece attached to the moveable slat by a rod through the piece.

3. The game apparatus of claim 1, wherein said number of slats being equal to the number of apertures in each slat.

4. The game apparatus of claim 3, wherein said number is four.

5. The game apparatus of claim 3, wherein said number is eight.

6. A method of playing a game by at least two players on a game apparatus comprising the steps of:

providing a gaming surface comprising at least four laterally, horizontally and slideably mounted, adjacently-configured slats, each slat having a plurality of apertures; each aperture containing a rotating triangular piece with three faces, each face having a color distinct from other faces, the distinct colors representing a neutral state position, a first player position and a second player position; said gaming surface configured to provide three modes of play, a first mode wherein all triangular pieces are showing a neutral state color on the surface at game commencement, a second mode wherein game pieces are turned to the color of a player at the option of the player during play or alternately a slat is moved horizontally one position in either direction, and a third mode being a game over mode wherein all game pieces are turned to the color of a player in a predetermined arrangement on the surface as shown by apertured slats; each of said apertured slats having a top surface and a bottom surface, said top surface of a flat, planar configuration lacking in any obstructive barriers;

each slat further including magnet attractant metal strips and a wave configuration on the bottom;

a base assembly top surface for slideably mounting said slats, including a magnet strip and a corresponding wave configuration to attract the slat to the base after sliding the slat one position demarcated by the waves alignment, thereby moving the slats and rotating the game pieces occupying said apertures, at the option of each player selecting a color specific to each of the players;

each of said players, in serial, turned order, selecting a move from one of two possible moves, said two possible moves including, (1) rotating a game piece in one of said apertures to their color thus occupying that aperture on one of said slats that is not already occupied by a player's color earlier turned therein; or (2) sliding any one of said slats linearly in one of two bidirectional manners, to the next, sequential stop;

repeating until one of the players has placed a predetermined number of game pieces in a predetermined arrangement wherein the game commences with the game pieces turned to a player's selected color in a predetermined arrangement.

7. The method of claim 6, wherein said number of slats being equal to the number of apertures in each slat.

8. The method of claim 7, wherein the number is four.

9. The method of claim 7, wherein the number is eight.

10. The method of claim 6, wherein the arrangement is linear.

11. The method of claim 7, wherein the arrangement is linear, and the linear number equals the number.

12. The method of claim 6, wherein the arrangement is a diamond.

13. The method of claim 6, wherein the apparatus is virtual, presented in a computer-assisted manner, and the method is practiced by entering data via a computer.

14. The method of claim 13, wherein said presentation involves the Internet.

15. The method of claim 13, wherein said computer comprises a touch screen for practicing said method.

16. The method of claim 13, wherein said at least two players practice said method via the Internet.

* * * * *